US010814452B2

(12) United States Patent
Xue et al.

(10) Patent No.: US 10,814,452 B2
(45) Date of Patent: Oct. 27, 2020

(54) WHEEL FINISHING DEVICE

(71) Applicant: CITIC Dicastal CO., LTD, Qinhuangdao (CN)

(72) Inventors: Bowen Xue, Qinhuangdao (CN); Xiuwei Wang, Qinhuangdao (CN); Guorui Wu, Qinhuangdao (CN); Jiandong Guo, Qinhuangdao (CN)

(73) Assignee: CITIC DICASTAL CO., LTD, Qinhuangdao, Hebei (CN)

( * ) Notice: Subject to any disclaimer, the term of this patent is extended or adjusted under 35 U.S.C. 154(b) by 354 days.

(21) Appl. No.: 15/941,192

(22) Filed: Mar. 30, 2018

(65) Prior Publication Data

US 2019/0193232 A1 Jun. 27, 2019

(30) Foreign Application Priority Data

Dec. 22, 2017 (CN) ..... 2017 1 1398776

(51) Int. Cl.

| | |
|---|---|
| ***B24B 9/00*** | (2006.01) |
| ***B24B 41/02*** | (2006.01) |
| ***B24B 47/12*** | (2006.01) |

(52) U.S. Cl.

CPC ..... *B24B 9/00* (2013.01); *B24B 41/02* (2013.01); *B24B 47/12* (2013.01)

(58) Field of Classification Search

CPC ..... B24B 9/00; B24B 47/12; B24B 27/04; B24B 27/0084; B24B 29/005; B24B 55/06; B24B 9/04; B24B 19/28; B24B 5/44; B24B 41/02; B24B 29/00; B24B 5/46; B24B 5/40

See application file for complete search history.

(56) References Cited

U.S. PATENT DOCUMENTS

| | | | | |
|---|---|---|---|---|
| 10,022,834 | B2 * | 7/2018 | Xue | B24B 29/005 |
| 10,112,282 | B2 * | 10/2018 | Xue | B24B 5/44 |
| 10,207,384 | B2 * | 2/2019 | Zheng | B24B 5/44 |
| 10,232,485 | B2 * | 3/2019 | Xue | B24B 5/44 |
| 10,232,490 | B2 * | 3/2019 | Xue | B24B 29/005 |
| 10,239,181 | B2 * | 3/2019 | Xue | B24B 27/0023 |
| 10,279,449 | B2 * | 5/2019 | Xue | B24B 9/04 |

* cited by examiner

*Primary Examiner* — Dung Van Nguyen
(74) *Attorney, Agent, or Firm* — Calfee, Halter & Griswold LLP

(57) ABSTRACT

The present application relates to a wheel finishing device, which includes a lower brush system, upper rim brush systems, a riser brush system, a valve hole brush system and the like. The device can be used for removing burrs from an upper rim, a center hole, a flange drainage channel, a riser and a valve hole of a wheel, and simultaneously has the characteristics of high automation degree, high removal efficiency, advanced process, strong generality and high safety and stability.

1 Claim, 2 Drawing Sheets

WHEEL FINISHING DEVICE

CROSS-REFERENCE TO RELATED APPLICATIONS

This application claims priority to Chinese Patent Application No. 2017113987763, filed on Dec. 22, 2017, which is hereby incorporated by reference in its entirety.

TECHNICAL FIELD

The present application relates to a burr removing device, and specifically, to a wheel burr removing device.

BACKGROUND ART

In the machining process of an aluminum alloy wheel, it is sure to produce burrs at an upper rim, a center hole, a flange drainage channel, a riser and a valve hole. If the produced burrs are not removed in time, the subsequent coating effect will be seriously affected, and even the wheel is corroded in advance in use.

SUMMARY OF THE INVENTION

The aim of the present application is to provide a wheel burr removing device, which can be used for removing burrs from an upper rim, a center hole, a flange drainage channel, a riser and a valve hole of a wheel.

In order to fulfill the above aim, the technical solution of the present application is:

Wheel finishing device, is composed of a frame, cylinders I, lower guide posts, lower guide sleeves, a lower fixed plate, a lower lifting plate, a guide rail I, a transverse sliding plate, a belt pulley I, a synchronous belt I, a belt pulley II, a guide rail II, a longitudinal sliding plate, a shaft I, a bearing seat I, a sliding sleeve I, a spring I, a sliding sleeve II, a spring II, a sliding sleeve III, a spring III, a sliding sleeve IV, a spring IV, a sliding sleeve V, a spring V, a floating brush, an upper fixed plate, a cylinder II, guide rails III, a left sliding plate, left bearing seats, left shafts, V-shaped rollers, racks I, a gear I, round brushes, transverse shafts, belt pulleys III, rotary supports, synchronous belts II, belt pulleys IV, servo motors I, shafts II, bearing seats II, servo motors II, sliding supports I, guide rails IV, racks II, gears II, a mounting plate, servo motors III, shafts III, bearing seats III, an upper lifting plate, upper guide posts, upper guide sleeves, cylinders III, servo motors IV, right shafts, right bearing seats, a right sliding plate, a servo motor V, a servo motor VI, a servo electric cylinder I, a conical grinding head, a spring VI, a fixed sleeve, a shaft IV, a bearing seat IV, a belt pulley V, a synchronous belt III, a belt pulley VI, a servo motor VII, a servo motor VIII, a gear III, a rack III, a guide rail V, a sliding support II, a guide rail VI, a servo motor IX, a gear IV, a rack IV, a fixed support, a belt pulley VII, a synchronous belt IV, a servo motor X, a bearing seat V, a shaft V, a belt pulley VIII, an oblique grinding head, a servo electric cylinder II and the like, wherein a lower lifting system includes: the two cylinders I and the four lower guide sleeves are all fixed on the lower fixed plate, and the four lower guide posts are matched with the lower guide sleeves and are fixed below the lower lifting plate; and output ends of the cylinders I are articulated with the lower part of the lower lifting plate.

A lower brush system includes: the transverse sliding plate is mounted above the lower lifting plate via the guide rail I; the servo electric cylinder I is fixed on the right side of the upper part of the lower lifting plate, and an output end of the servo electric cylinder I is connected with one side of the transverse sliding plate; the longitudinal sliding plate is mounted above the transverse sliding plate via the guide rail II; the servo electric cylinder II is fixed on one side of the upper part of the transverse sliding plate, and an output end of the servo electric cylinder II is connected with one side of the longitudinal sliding plate; the bearing seat I is fixed above the longitudinal sliding plate; the shaft I is mounted inside the bearing seat I via bearings; the belt pulley II is fixed below the shaft I; the servo motor VI is also fixed above the longitudinal sliding plate, and the belt pulley I is fixed at the output end of the servo motor VI; the belt pulley I is connected with the belt pulley II via the synchronous belt I; and the sliding sleeve I is fixed above the shaft I.

A lower floating brush head includes: the spring I is arranged inside the sliding sleeve I; the outer side of the sliding sleeve II is matched with the inner side of the sliding sleeve I, and the sliding sleeve II is arranged above the spring I; the outer side of the sliding sleeve III is matched with the inner side of the sliding sleeve II, and the sliding sleeve III is arranged above the spring II; the outer side of the sliding sleeve IV is matched with the inner side of the sliding sleeve III, and the sliding sleeve IV is arranged above the spring III; the outer side of the sliding sleeve V is matched with the inner side of the sliding sleeve IV, and the sliding sleeve V is arranged above the spring IV; the outer side of the floating brush is matched with the inner side of the sliding sleeve V, and the floating brush is arranged above the spring V.

A synchronous clamping and rotating system includes: the gear I is fixed above the upper fixed plate; the left sliding plate is mounted above the upper fixed plate via a guide rail III; the cylinder II is also fixed above the upper fixed plate, and an output end of the cylinder II is connected with the lower part of the left sliding plate; a rack I is fixed below the left sliding plate, and the two left bearing seats are fixed above the left sliding plate; the two left shafts are mounted inside the left bearing seats via bearings; V-shaped rollers are respectively mounted above the two left shafts; the right sliding plate is mounted above the upper fixed plate via a guide rail III; a rack I is fixed below the right sliding plate, and the two right bearing seats are fixed above the right sliding plate; the rack I below the left sliding plate and the rack I below the right sliding plate are simultaneously engaged with the gear I; the two right shafts are mounted inside the right bearing seats via bearings; V-shaped rollers are respectively mounted above the two right shafts; the servo motor V is fixed below the right sliding plate, and an output end of the servo motor V is connected with the lower end of one right shaft.

An upper rim brush system includes: the round brush is mounted below the rotary support via the transverse shaft; the belt pulley III is mounted on the left side of the transverse shaft; the servo motor I is fixed on the left side of the rotary support via a transition flange, and the belt pulley IV is fixed at the output end of the servo motor I; the belt pulley III is connected with the belt pulley IV via the synchronous belt II; the bearing seat II is fixed below the sliding support I; the shaft II is mounted inside the bearing seat II via bearings; the rotary support is fixed at the bottom of the shaft II; the servo motor II is fixed at the top of a bottom plate of the sliding support I, and an output end of the servo motor II is connected with the upper part of the shaft II; the top of the sliding support I is mounted below the mounting plate via the guide rail IV; the mounting plate is fixed below the shaft III; the servo motor III is fixed above the mounting plate, and the gear II is fixed at the output end of the servo motor III; the rack II engaged with the gear II is fixed on one side of the sliding support I; and this device includes a left upper rim brush system and a right upper rim brush system which are symmetric.

An upper lifting and rotating system includes: the bearing seats III are fixed below the upper lifting plate; the shafts III are mounted inside the bearing seats III via bearings; the servo motors IV are fixed above the upper lifting plate, and an output ends of the servo motors IV are connected with the upper parts of the shafts III; the four upper guide posts are fixed above the upper lifting plate; the four upper guide sleeves matched with the upper guide posts are fixed at the top of the frame; the two cylinders III are also fixed at the top of the frame, and output ends of the two cylinders III are articulated with the upper part of the upper lifting plate.

A riser brush system includes: the upper part of the conical grinding head is matched with the fixed sleeve; the spring VI is arranged inside the fixed sleeve and above the conical grinding head; the bearing seat IV is fixed below the mounting plate via a transition flange; the shaft IV is mounted inside the bearing seat IV via bearings; the belt pulley V is fixed above the shaft IV, and the fixed sleeve is fixed below the shaft IV; the servo motor VII is fixed above the mounting plate, and the belt pulley VI is fixed at the output end of the servo motor VII; and the belt pulley V is connected with the belt pulley VI via the synchronous belt III.

A valve hole brush system includes: the bearing seat V is fixed below the fixed support; the shaft V is mounted inside the bearing seat V via bearings; the belt pulley VII is fixed above the shaft V, and the oblique grinding head is fixed below the shaft V; the servo motor X is fixed above the fixed support via a transition flange, and the belt pulley VIII is fixed at the output end of the servo motor X; the belt pulley VII is connected with the belt pulley VIII via the synchronous belt IV; the servo motor IX is fixed on the left side of the fixed support, and the gear IV is fixed at the output end of the servo motor IX; the gear IV is engaged with the rack IV; the rack IV is fixed on the left side of the sliding support II; the right side of the fixed support is mounted on the left side of the sliding support II via the guide rail VI; the top of the sliding support II is mounted below the mounting plate via the guide rail V; the servo motor VIII is fixed above the mounting plate, and the gear III is fixed at the output end of the servo motor VIII; the gear III is engaged with the rack III; and the rack III is fixed on the left side of the sliding support II.

In the working process, the cylinder II drives the four V-shaped rollers via the gear I and the racks I to synchronously clamp a wheel, and the servo motor V drives the clamped wheel to rotate; the spring I, the spring II, the spring III, the spring IV and the spring V enable respective sliding sleeves thereon to be in a floating state; the servo motor VI drives the lower floating brush head via the synchronous belt I to rotate; the cylinders I can drive the rotating lower floating brush head via the lower guide posts to ascend, and when the lower floating brush head contacts a center hole of the wheel, burrs therein can be removed; the servo electric cylinder I drives the lower floating brush head via the guide rail I to move left and right; the servo electric cylinder II drives the lower floating brush head via the guide rail II to move front and back; the lower floating brush head can follow the structure of a wheel flange drainage channel, and can remove burrs therein at the same time; the servo motors III enable the two round brushes to be adjusted to the positions above an upper rim via the gears II, the racks II and the guide rails IV; the servo motors I drive the round brushes via the synchronous belts II to rotate; the servo motor drives one round brush via the shaft II to rotate 90 degrees, so that the two round brushes are in a vertical state; the servo motors IV drive the two round brushes via the shafts III to rotate circumferentially; the cylinders III drive the two round brushes via the upper guide posts to descend, and when the round brushes contact the upper rim of the wheel, burrs therein can be removed; the servo motor VII drives the shaft IV and the conical grinding head via the synchronous belt III to rotate; the spring VI keeps the conical grinding head in a floating state; the cylinders III drive the rotating conical grinding head via the upper guide posts to descend, and when the conical grinding head contacts a riser of the wheel, burrs therein can be removed; the servo motor X drives the oblique grinding head via the synchronous belt IV to rotate; the servo motor IX drives the oblique grinding head via the gear IV, the rack IV and the guide rail VI to move up and down; the servo motor VIII drives the oblique grinding head via the gear III, the rack III and the guide rail V to move left and right; the cylinders III can drive the rotating oblique grinding head via the upper guide posts to descend continuously, and when the oblique grinding head contacts a valve hole of the wheel, burrs therein can be removed.

The present application can be used for removing burrs from an upper rim, a center hole, a flange drainage channel, a riser and a valve hole of a wheel, and simultaneously has the characteristics of high automation degree, high removal efficiency, advanced process, strong generality and high safety and stability.

Figure 1:
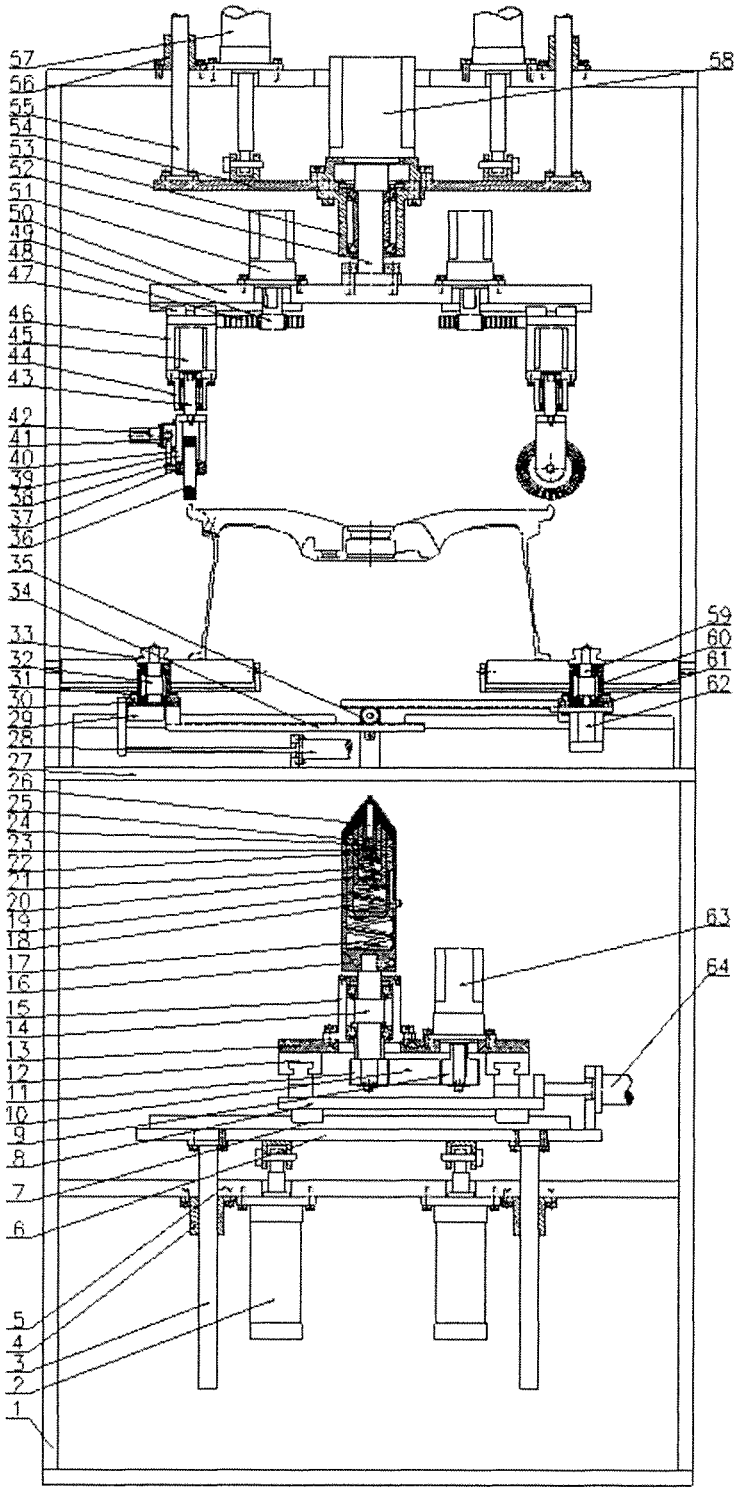
FIG. 1 is a front view of a wheel finishing device of the present application.
Figure 2:
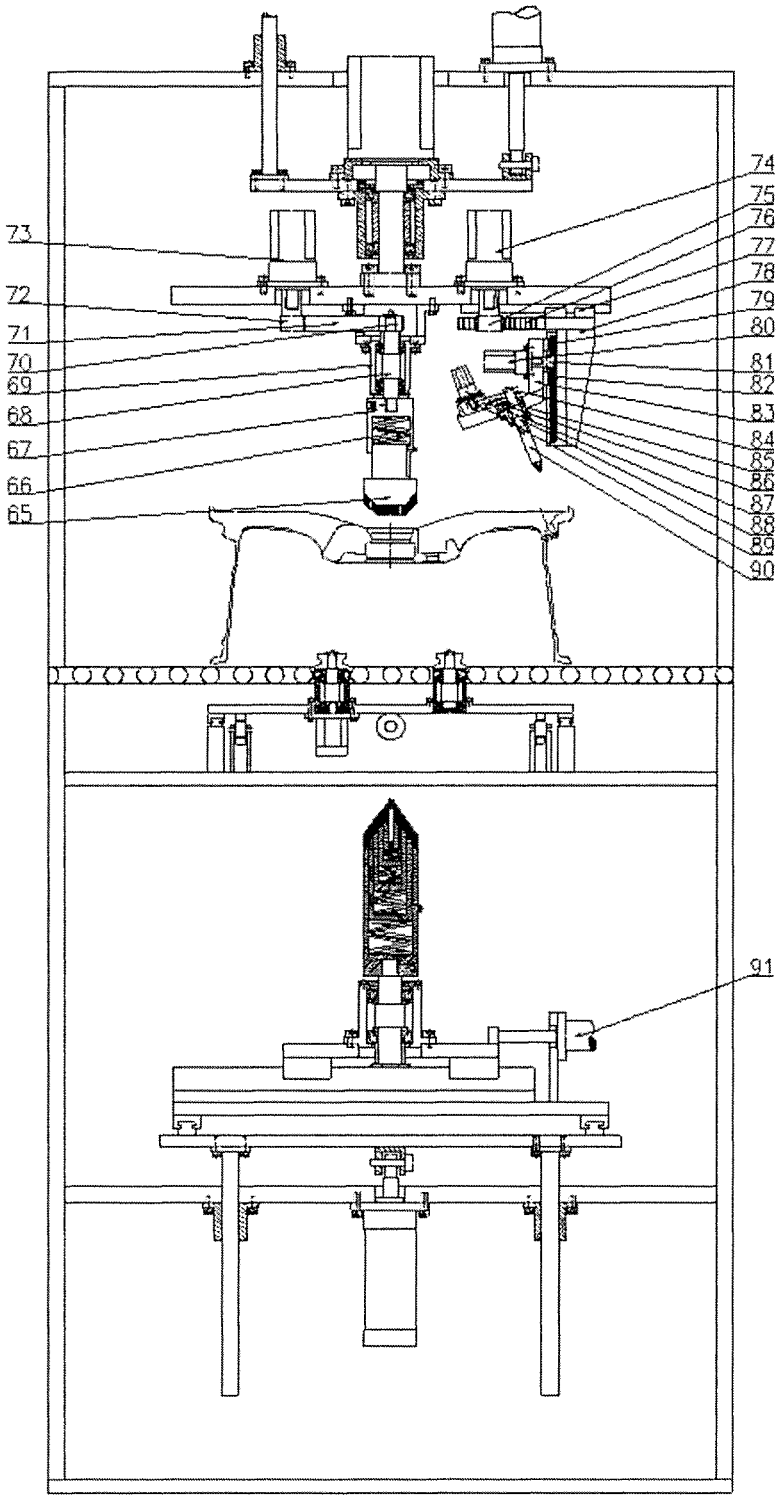
FIG. 2 is a left view of the wheel finishing device of the present application.

In which, 1—frame, 2—cylinder I, 3—lower guide post, 4—lower guide sleeve, 5—lower fixed plate, 6—lower lifting plate, 7—guide rail I, 8—transverse sliding plate, 9—belt pulley I, 10—synchronous belt I, 11—belt pulley II, 12—guide rail II, 13—longitudinal sliding plate, 14—shaft I, 15—bearing seat I, 16—sliding sleeve I, 17—spring I, 18—sliding sleeve II, 19—spring II, 20—sliding sleeve III, 21—spring III, 22—sliding sleeve IV, 23—spring IV, 24—sliding sleeve V, 25—spring V, 26—floating brush, 27—upper fixed plate, 28—cylinder II, 29—guide rail III, 30—left sliding plate, 31—left bearing seat, 32—left shaft, 33—V—shaped roller, 34—rack I, 35—gear I, 36—round brush, 37—transverse shaft, 38—belt pulley III, 39—rotary support, 40—synchronous belt II, 41—belt pulley IV, 42—servo motor I, 43—shaft II, 44—bearing seat II, 45—servo motor II, 46—sliding support I, 47—guide rail IV, 48—rack II, 49—gear II, 50—mounting plate, 51—servo motor III, 52—shaft III, 53—bearing seat III, 54—upper lifting plate, 55—upper guide post, 56—upper guide sleeve, 57—cylinder III, 58—servo motor IV, 59—right shaft, 60—right bearing seat, 61—right sliding plate, 62—servo motor V, 63—servo motor VI, 64—servo electric cylinder I, 65—conical grinding head, 66—spring VI, 67—fixed sleeve, 68—shaft IV, 69—bearing seat IV, 70—belt pulley V, 71—synchronous belt III, 72—belt pulley VI, 73—servo motor VII, 74—servo motor VIII, 75—gear III, 76—rack III, 77—guide rail V, 78—sliding support II, 79—guide rail VI, 80—servo motor IX, 81—gear IV, 82—rack IV, 83—fixed support, 84—belt pulley VII, 85—synchronous belt IV, 86—servo motor X, 87—bearing seat V, 88—shaft V, 89—belt pulley VIII, 90—oblique grinding head, 91—servo electric cylinder II.

DETAILED DESCRIPTION OF THE INVENTION

Specific details and working conditions of a device provided by the present application will be described below in combination with the accompanying drawings.

The device is composed of a frame 1, cylinders I 2, lower guide posts 3, lower guide sleeves 4, a lower fixed plate 5, a lower lifting plate 6, a guide rail I 7, a transverse sliding plate 8, a belt pulley I 9, a synchronous belt I 10, a belt pulley II 11, a guide rail II 12, a longitudinal sliding plate 13, a shaft I 14, a bearing seat I 15, a sliding sleeve I 16, a spring I 17, a sliding sleeve II 18, a spring II 19, a sliding sleeve III 20, a spring III 21, a sliding sleeve IV 22, a spring IV 23, a sliding sleeve V 24, a spring V 25, a floating brush 26, an upper fixed plate 27, a cylinder II 28, guide rails III 29, a left sliding plate 30, left bearing seats 31, left shafts 32, V-shaped rollers 33, racks I 34, a gear I 35, round brushes 36, transverse shafts 37, belt pulleys III 38, rotary supports 39, synchronous belts II 40, belt pulleys IV 41, servo motors I 42, shafts II 43, bearing seats II 44, servo motors II 45, sliding supports I 46, guide rails IV 47, racks II 48, gears II 49, a mounting plate 50, servo motors III 51, shafts III 52, bearing seats III 53, an upper lifting plate 54, upper guide posts 55, upper guide sleeves 56, cylinders III 57, servo motors IV 58, right shafts 59, right bearing seats 60, a right sliding plate 61, a servo motor V 62, a servo motor VI 63, a servo electric cylinder I 64, a conical grinding head 65, a spring VI 66, a fixed sleeve 67, a shaft IV 68, a bearing seat IV 69, a belt pulley V 70, a synchronous belt III 71, a belt pulley VI 72, a servo motor VII 73, a servo motor VIII 74, a gear III 75, a rack III 76, a guide rail V 77, a sliding support II 78, a guide rail VI 79, a servo motor IX 80, a gear IV 81, a rack IV 82, a fixed support 83, a belt pulley VII 84, a synchronous belt IV 85, a servo motor X 86, a bearing seat V 87, a shaft V 88, a belt pulley VIII 89, an oblique grinding head 90, a servo electric cylinder II 91 and the like, wherein a lower lifting system includes: the two cylinders I 2 and the four lower guide sleeves 4 are all fixed on the lower fixed plate 5, and the four lower guide posts 3 are matched with the lower guide sleeves 4 and are fixed below the lower lifting plate 6; and output ends of the cylinders I 2 are articulated with the lower part of the lower lifting plate 6.

A lower brush system includes: the transverse sliding plate 8 is mounted above the lower lifting plate 6 via the guide rail I 7; the servo electric cylinder I 64 is fixed on the right side of the upper part of the lower lifting plate 6, and an output end of the servo electric cylinder I 64 is connected with one side of the transverse sliding plate 8; the longitudinal sliding plate 13 is mounted above the transverse sliding plate 8 via the guide rail II 12; the servo electric cylinder II 91 is fixed on one side of the upper part of the transverse sliding plate 8, and an output end of the servo electric cylinder II 91 is connected with one side of the longitudinal sliding plate 13; the bearing seat I 15 is fixed above the longitudinal sliding plate 13; the shaft I 14 is mounted inside the bearing seat I 15 via bearings; the belt pulley II 11 is fixed below the shaft I 14; the servo motor VI 63 is also fixed above the longitudinal sliding plate 13, and the belt pulley I 9 is fixed at the output end of the servo motor VI 63; the belt pulley I 9 is connected with the belt pulley II 11 via the synchronous belt I 10; and the sliding sleeve I 16 is fixed above the shaft I 14.

A lower floating brush head includes: the spring I 17 is arranged inside the sliding sleeve I 16; the outer side of the sliding sleeve II 18 is matched with the inner side of the sliding sleeve I 16, and the sliding sleeve II 18 is arranged above the spring I 17; the outer side of the sliding sleeve III 20 is matched with the inner side of the sliding sleeve II 18, and the sliding sleeve III 20 is arranged above the spring II 19; the outer side of the sliding sleeve IV 22 is matched with the inner side of the sliding sleeve III 20, and the sliding sleeve IV 22 is arranged above the spring III 21; the outer side of the sliding sleeve V 24 is matched with the inner side of the sliding sleeve IV 22, and the sliding sleeve V 24 is arranged above the spring IV 23; the outer side of the floating brush 26 is matched with the inner side of the sliding sleeve V 24, and the floating brush 26 is arranged above the spring V 25.

A synchronous clamping and rotating system includes: the gear I 35 is fixed above the upper fixed plate 27; the left sliding plate 30 is mounted above the upper fixed plate 27 via a guide rail III 29; the cylinder II 28 is also fixed above the upper fixed plate 27, and an output end of the cylinder II 28 is connected with the lower part of the left sliding plate 30; a rack I 34 is fixed below the left sliding plate 30, and the two left bearing seats 31 are fixed above the left sliding plate 30; the two left shafts 32 are mounted inside the left bearing seats 31 via bearings; V-shaped rollers 33 are respectively mounted above the two left shafts 32; the right sliding plate 61 is mounted above the upper fixed plate 27 via a guide rail III 29; a rack I 34 is fixed below the right sliding plate 61, and the two right bearing seats 60 are fixed above the right sliding plate 61; the rack I 34 below the left sliding plate 30 and the rack I 34 below the right sliding plate 61 are simultaneously engaged with the gear I 35; the two right shafts 59 are mounted inside the right bearing seats 60 via bearings; V-shaped rollers 33 are respectively mounted above the two right shafts 59; the servo motor V 62 is fixed below the right sliding plate 61, and an output end of the servo motor V 62 is connected with the lower end of one right shaft 59.

An upper rim brush system includes: the round brush 36 is mounted below the rotary support 39 via the transverse shaft 37; the belt pulley III 38 is mounted on the left side of the transverse shaft 37; the servo motor I 42 is fixed on the left side of the rotary support 39 via a transition flange, and the belt pulley IV 41 is fixed at the output end of the servo motor I 42; the belt pulley III 38 is connected with the belt pulley IV 41 via the synchronous belt II 40; the bearing seat II 44 is fixed below the sliding support I 46; the shaft II 43 is mounted inside the bearing seat II 44 via bearings; the rotary support 39 is fixed at the bottom of the shaft II 43; the servo motor II 45 is fixed at the top of a bottom plate of the sliding support I 46, and an output end of the servo motor II 45 is connected with the upper part of the shaft II 43; the top of the sliding support I 46 is mounted below the mounting plate 50 via the guide rail IV 47; the mounting plate 50 is fixed below the shaft III 52; the servo motor III 51 is fixed above the mounting plate 50, and the gear II 49 is fixed at the output end of the servo motor III 51; the rack II 48 engaged with the gear II 49 is fixed on one side of the sliding support I 46; and this device includes a left upper rim brush system and a right upper rim brush system which are symmetric.

An upper lifting and rotating system includes: the bearing seats III 53 are fixed below the upper lifting plate 54; the shafts III 52 are mounted inside the bearing seats III 53 via bearings; the servo motors IV 58 are fixed above the upper lifting plate 54, and output ends of the servo motors IV 58 are connected with the upper parts of the shafts III 52; the four upper guide posts 55 are fixed above the upper lifting plate 54; the four upper guide sleeves 56 matched with the upper guide posts 55 are fixed at the top of the frame 1; the two cylinders III 57 are also fixed at the top of the frame 1, and output ends of the two cylinders III 57 are articulated with the upper part of the upper lifting plate 54.

A riser brush system includes: the upper part of the conical grinding head 65 is matched with the fixed sleeve 67; the spring VI 66 is arranged inside the fixed sleeve 67 and above the conical grinding head 65; the bearing seat IV 69 is fixed below the mounting plate 50 via a transition flange; the shaft IV 68 is mounted inside the bearing seat IV 69 via bearings; the belt pulley V 70 is fixed above the shaft IV 68, and the fixed sleeve 67 is fixed below the shaft IV 68; the servo motor VII 73 is fixed above the mounting plate 50, and the belt pulley VI 72 is fixed at the output end of the servo motor VII 73; and the belt pulley V 70 is connected with the belt pulley VI 72 via the synchronous belt III 71.

A valve hole brush system includes: the bearing seat V 87 is fixed below the fixed support 83; the shaft V 88 is mounted inside the bearing seat V 87 via bearings; the belt pulley VII 84 is fixed above the shaft V 88, and the oblique grinding head 90 is fixed below the shaft V 88; the servo motor X 86 is fixed above the fixed support 83 via a transition flange, and the belt pulley VIII 89 is fixed at the output end of the servo motor X 86; the belt pulley VII 84 is connected with the belt pulley VIII 89 via the synchronous belt IV 85; the servo motor IX 80 is fixed on the left side of the fixed support 83, and the gear IV 81 is fixed at the output end of the servo motor IX 80; the gear IV 81 is engaged with the rack IV 82; the rack IV 82 is fixed on the left side of the sliding support II 78; the right side of the fixed support 83 is mounted on the left side of the sliding support II 78 via the guide rail VI 79; the top of the sliding support II 78 is mounted below the mounting plate 50 via the guide rail V 77; the servo motor VIII 74 is fixed above the mounting plate 50, and the gear III 75 is fixed at the output end of the servo motor VIII 74; the gear III 75 is engaged with the rack III 76; and the rack III 76 is fixed on the left side of the sliding support II 78.

In the working process, the cylinder II 28 drives the four V-shaped rollers 33 via the gear I 35 and the racks I 34 to synchronously clamp a wheel, and the servo motor V 62 drives the clamped wheel to rotate; the spring I 17, the spring II 19, the spring III 21, the spring IV 23 and the spring V 25 enable respective sliding sleeves thereon to be in a floating state; the servo motor VI 63 drives the lower floating brush head via the synchronous belt I 10 to rotate; the cylinders I 2 can drive the rotating lower floating brush head via the lower guide posts 3 to ascend, and when the lower floating brush head contacts a center hole of the wheel, burrs therein can be removed; the servo electric cylinder I 64 drives the lower floating brush head via the guide rail I 7 to move left and right; the servo electric cylinder II 91 drives the lower floating brush head via the guide rail II 12 to move front and back; the lower floating brush head can follow the structure of a wheel flange drainage channel, and can remove burrs therein at the same time; the servo motors III 51 enable the two round brushes 36 to be adjusted to the positions above an upper rim via the gears II 49, the racks II 48 and the guide rails IV 47; the servo motors I 42 drive the round brushes 36 via the synchronous belts II 40 to rotate; the servo motor 45 drives one round brush 36 via the shaft II 43 to rotate 90 degrees, so that the two round brushes 36 are in a vertical state; the servo motors IV 58 drive the two round brushes 36 via the shafts III 52 to rotate circumferentially; the cylinders III 57 drive the two round brushes 36 via the upper guide posts 55 to descend, and when the round brushes 36 contact the upper rim of the wheel, burrs therein can be removed; the servo motor VII 73 drives the shaft IV 68 and the conical grinding head 65 via the synchronous belt III 71 to rotate; the spring VI 66 keeps the conical grinding head 65 in a floating state; the cylinders III 57 drive the rotating conical grinding head 65 via the upper guide posts 55 to descend, and when the conical grinding head 65 contacts a riser of the wheel, burrs therein can be removed; the servo motor X 86 drives the oblique grinding head 90 via the synchronous belt IV 85 to rotate; the servo motor IX 80 drives the oblique grinding head 90 via the gear IV 81, the rack IV 82 and the guide rail VI 79 to move up and down; the servo motor VIII 74 drives the oblique grinding head 90 via the gear III 75, the rack III 76 and the guide rail V 77 to move left and right; the cylinders III 57 can drive the rotating oblique grinding head 90 via the upper guide posts 55 to descend continuously, and when the oblique grinding head 90 contacts a valve hole of the wheel, burrs therein can be removed.

The foregoing descriptions of specific exemplary embodiments of the present application have been presented for purposes of illustration and description. They are not intended to be exhaustive or to limit the application to the precise forms disclosed, and obviously many modifications and variations are possible in light of the above teachings. The exemplary embodiments were chosen and described in order to explain certain principles of the application and their practical application, to thereby enable others skilled in the art to make and utilize various exemplary embodiments of the present application, as well as various alternatives and modifications thereof. It is intended that the scope of the application be defined by the Claims appended hereto and their equivalents.

What is claimed is:

1. Wheel finishing device, comprising a frame, cylinders I, lower guide posts, lower guide sleeves, a lower fixed plate, a lower lifting plate, a guide rail I, a transverse sliding plate, a belt pulley I, a synchronous belt I, a belt pulley II, a guide rail II, a longitudinal sliding plate, a shaft I, a bearing seat I, a sliding sleeve I, a spring I, a sliding sleeve II, a spring II, a sliding sleeve III, a spring III, a sliding sleeve IV, a spring IV, a sliding sleeve V, a spring V, a floating brush, an upper fixed plate, a cylinder II, guide rails III, a left sliding plate, two left bearing seats, two left shafts, V-shaped rollers, racks I, a gear I, round brushes, transverse shafts, belt pulleys III, rotary supports, synchronous belts II, belt pulleys IV, servo motors I, shafts II, bearing seats II, servo motors II, sliding supports I, guide rails IV, racks II, gears II, a mounting plate, servo motors III, shafts III, bearing seats III, an upper lifting plate, four upper guide posts, four upper guide sleeves, two cylinders III, servo motors IV, two right shafts, right bearing seats, a right sliding plate, a servo motor V, a servo motor VI, a servo electric cylinder I, a conical grinding head, a spring VI, a fixed sleeve, a shaft IV, a bearing seat IV, a belt pulley V, a synchronous belt III, a belt pulley VI, a servo motor VII, a servo motor VIII, a gear III, a rack III, a guide rail V, a sliding support II, a guide rail VI, a servo motor IX, a gear IV, a rack IV, a fixed support, a belt pulley VII, a synchronous belt IV, a servo motor X, a bearing seat V, a shaft V, a belt pulley VIII, an oblique grinding head and a servo electric cylinder II, wherein a lower lifting system comprises: the two cylinders I and the four lower guide sleeves are all fixed on the lower fixed plate, and the four lower guide posts are matched with the lower guide sleeves and are fixed below the lower lifting plate; and output ends of the cylinders I are articulated with the lower part of the lower lifting plate;

a lower brush system comprises: the transverse sliding plate is mounted above the lower lifting plate via the guide rail I; the servo electric cylinder I is fixed on the right side of the upper part of the lower lifting plate, and an output end of the servo electric cylinder I is connected with one side of the transverse sliding plate; the longitudinal sliding plate is mounted above the transverse sliding plate via the guide rail II; the servo electric cylinder II is fixed on one side of the upper part of the transverse sliding plate, and an output end of the servo electric cylinder II is connected with one side of the longitudinal sliding plate; the bearing seat I is fixed above the longitudinal sliding plate; the shaft I is mounted inside the bearing seat I via bearings; the belt pulley II is fixed below the shaft I; the servo motor VI is also fixed above the longitudinal sliding plate, and the belt pulley I is fixed at an output end of the servo motor VI; the belt pulley I is connected with the belt pulley II via the synchronous belt I; and the sliding sleeve I is fixed above the shaft I;

a lower floating brush head comprises: the spring I is arranged inside the sliding sleeve I; the outer side of the sliding sleeve II is matched with the inner side of the sliding sleeve I, and the sliding sleeve II is arranged above the spring I; the outer side of the sliding sleeve III is matched with the inner side of the sliding sleeve II, and the sliding sleeve III is arranged above the spring II; the outer side of the sliding sleeve IV is matched with the inner side of the sliding sleeve III, and the sliding sleeve IV is arranged above the spring III; the outer side of the sliding sleeve V is matched with the inner side of the sliding sleeve IV, and the sliding sleeve V is arranged above the spring IV; the outer side of the floating brush is matched with the inner side of the sliding sleeve V, and the floating brush is arranged above the spring V;

a synchronous clamping and rotating system comprises: the gear I is fixed above the upper fixed plate; the left sliding plate is mounted above the upper fixed plate via a guide rail III; the cylinder II is also fixed above the upper fixed plate, and an output end of the cylinder II is connected with the lower part of the left sliding plate; a rack I is fixed below the left sliding plate, and the two left bearing seats are fixed above the left sliding plate; the two left shafts are mounted inside the two left bearing seats via bearings; V-shaped rollers are respectively mounted above the two left shafts; the right sliding plate is mounted above the upper fixed plate via a guide rail III; a rack I is fixed below the right sliding plate, and the two right bearing seats are fixed above the right sliding plate; the rack I below the left sliding plate and the rack I below the right sliding plate are simultaneously engaged with the gear I; the two right shafts are mounted inside the right bearing seats via bearings; V-shaped rollers are respectively mounted above the two right shafts; the servo motor V is fixed below the right sliding plate, and an output end of the servo motor V is connected with the lower end of one of the two right shafts;

an upper rim brush system comprises: the round brush is mounted below the rotary support via the transverse shaft; the belt pulley III is mounted on the left side of the transverse shaft; the servo motor I is fixed on the left side of the rotary support via a transition flange, and the belt pulley IV is fixed at an output end of the servo motor I; the belt pulley III is connected with the belt pulley IV via the synchronous belt II; the bearing seat II is fixed below the sliding support I; the shaft II is mounted inside the bearing seat II via bearings; the rotary support is fixed at the bottom of the shaft II; the servo motor II is fixed at the top of a bottom plate of the sliding support I, and an output end of the servo motor II is connected with the upper part of the shaft II; the top of the sliding support I is mounted below the mounting plate via the guide rail IV; the mounting plate is fixed below the shaft III; the servo motor III is fixed above the mounting plate, and the gear II is fixed at an output end of the servo motor III; the rack II engaged with the gear II is fixed on one side of the sliding support I; and this device comprises a left upper rim brush system and a right upper rim brush system which are symmetric;

an upper lifting and rotating system comprises: the bearing seats III are fixed below the upper lifting plate; the shafts III are mounted inside the bearing seats III via bearings; the servo motors IV are fixed above the upper lifting plate, and output ends of the servo motors IV are connected with the upper parts of the shafts III; the four upper guide posts are fixed above the upper lifting plate; the four upper guide sleeves matched with the four upper guide posts are fixed at the top of the frame; the two cylinders III are also fixed at the top of the frame, and output ends of the two cylinders III are articulated with the upper part of the upper lifting plate;

a riser brush system comprises: the upper part of the conical grinding head is matched with the fixed sleeve; the spring VI is arranged inside the fixed sleeve and above the conical grinding head; the bearing seat IV is fixed below the mounting plate via a transition flange; the shaft IV is mounted inside the bearing seat IV via bearings; the belt pulley V is fixed above the shaft IV, and the fixed sleeve is fixed below the shaft IV; the servo motor VII is fixed above the mounting plate, and the belt pulley VI is fixed at an output end of the servo motor VII; and the belt pulley V is connected with the belt pulley VI via the synchronous belt III;

a valve hole brush system comprises: the bearing seat V is fixed below the fixed support; the shaft V is mounted inside the bearing seat V via bearings; the belt pulley VII is fixed above the shaft V, and the oblique grinding head is fixed below the shaft V; the servo motor X is fixed above the fixed support via a transition flange, and the belt pulley VIII is fixed at an output end of the servo motor X; the belt pulley VII is connected with the belt pulley VIII via the synchronous belt IV; the servo motor IX is fixed on the left side of the fixed support, and the gear IV is fixed at an output end of the servo motor IX; the gear IV is engaged with the rack IV; the rack IV is fixed on the left side of the sliding support II; the right side of the fixed support is mounted on the left side of the sliding support II via the guide rail VI; the top of the sliding support II is mounted below the mounting plate via the guide rail V; the servo motor VIII is fixed above the mounting plate, and the gear III is fixed at an output end of the servo motor VIII; the gear III is engaged with the rack III; and the rack III is fixed on the left side of the sliding support II.

* * * * *